US005562463A

United States Patent [19]

Tan

[11] Patent Number: 5,562,463

[45] Date of Patent: Oct. 8, 1996

[54] I/O CARD WITH FLEXIBLE EXTENDING I/O PORT

[75] Inventor: Haw-Chan Tan, Diamond Bar, Calif.

[73] Assignee: Hon Hai Precision Ind. Co. Ltd., Taiwan

[21] Appl. No.: 289,421

[22] Filed: Aug. 12, 1994

[51] Int. Cl.[6] ..... H01R 11/00

[52] U.S. Cl. ..... 439/76.1; 439/502

[58] Field of Search ..... 439/502, 676, 439/31, 76.1, 76.2, 928.1

[56] References Cited

U.S. PATENT DOCUMENTS

| | | | |
|---|---|---|---|
| 4,767,338 | 8/1988 | Dennis et al. | 439/76.1 |
| 4,889,498 | 12/1989 | Mizuta | 439/76.1 |
| 5,260,994 | 11/1993 | Suffi | 439/676 |
| 5,409,385 | 4/1995 | Tan et al. | 439/76.1 |

*Primary Examiner*—Gary F. Paumen
*Assistant Examiner*—Barry Matthew L. Standig

[57] ABSTRACT

An I/O card (10) includes a frame (12) shielded by outer covers (14, 16), and an internal PC board (20) positioned therein. A connector (24) is positioned at one end of the I/O card (10) for mating a corresponding memory card connector in the computer. A deflectable I/O port assembly (30) which can be angularly displaced with regard to the I/O card (10), extends outwardly at the other end and comprises at least one standard I/O connector (32) whose dimension is substantially larger than the thickness of the I/O card (10). A displaceable section (42) is connected between the standard I/O connector (32) and the I/O card (10) wherein conductors (34) are positioned along the displaceable section (42) for electrically connecting the standard I/O connector (32) and the PC board (20).

7 Claims, 7 Drawing Sheets

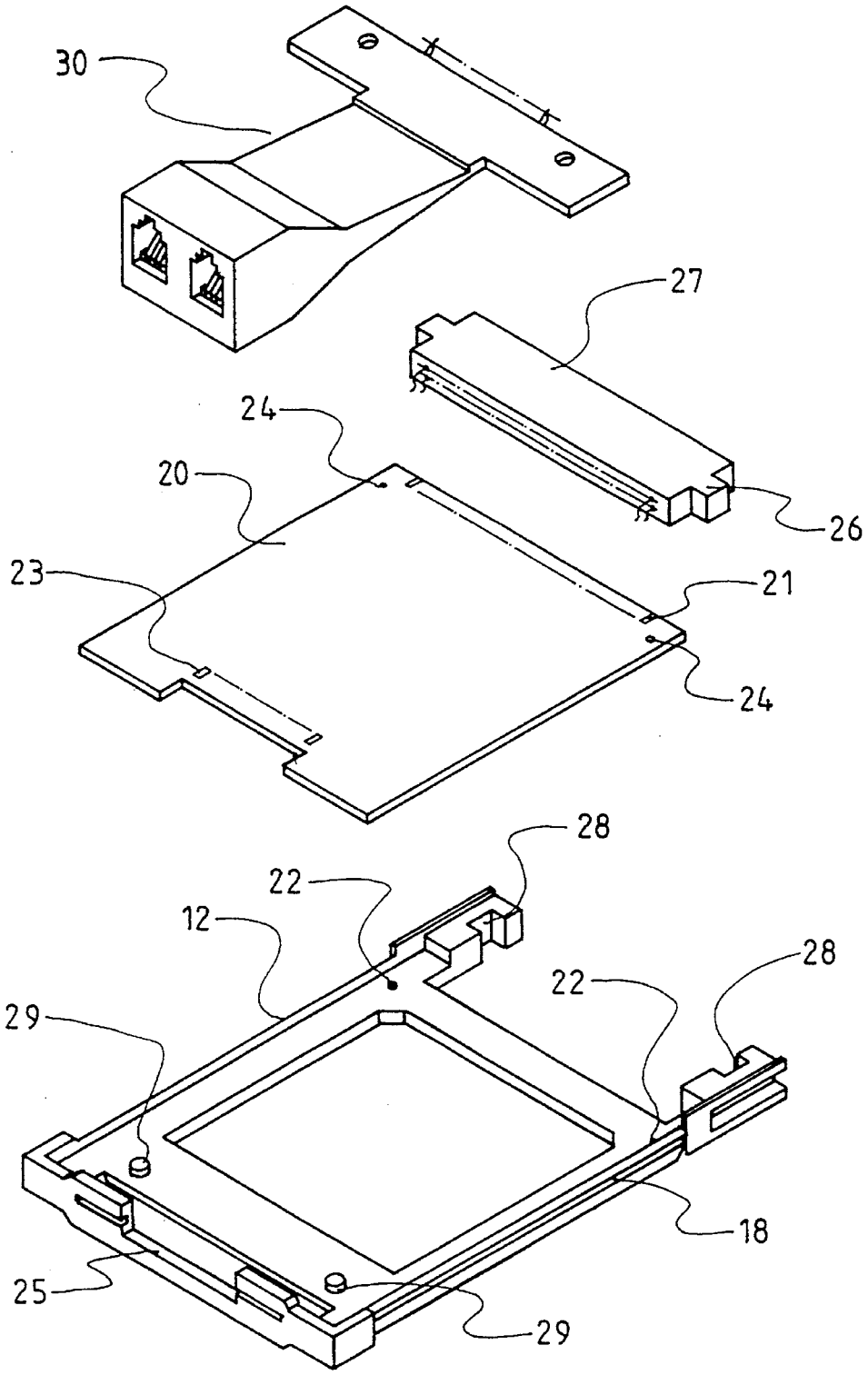
FIG, 2

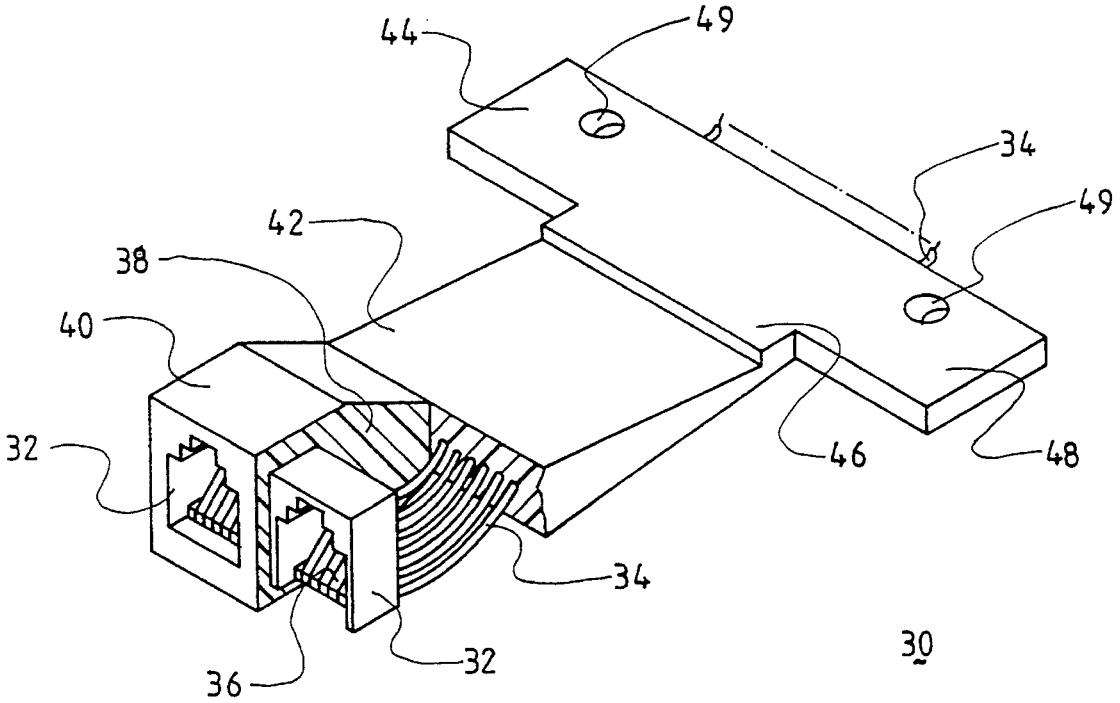
FIG,3
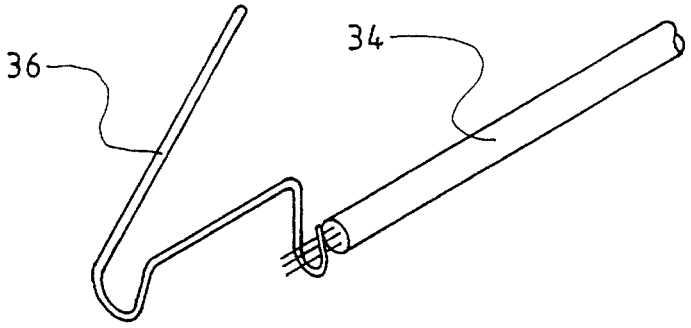
FIG,4

FIG,7

I/O CARD WITH FLEXIBLE EXTENDING I/O PORT

BACKGROUND OF THE INVENTION

1. Field of The Invention

The invention relates to card-like means for use with the computer, particularly to an I/O card which functions as an interface, wherein one end of each I/O card mates a connector of the computer, and the other end couples to a periphery, such as a modem, a printer or the a device in a multi-media system.

2. The Prior Art

I/O cards become more popular in the computer industry presently, and the general structure of the I/O card can be referred to U.S. Pat. Nos. 5,207,586, 5,242,310, 5,244,397, 5,330,360 and 5,333,100. Moreover, in U.S. Pat. No. 5,183,404, one problem is presented that because the I/O card is such thin that the I/O port, i.e., connector, of such I/O card can not directly coupled to the larger standard complementary connector of a periphery, such as a phone jack. In FIGS. 7 and 8 of such patent disclose two traditional methods to solve the aforementioned incompatibility problem of interconnection between the I/O connector of the I/O card and the complementary connector of the periphery. One is to use a cable assembly, of which one end has a tiny connector for mating the tiny I/O connector of the I/O card, and the other end has a standard connector for mating the standard connector of the periphery so that the I/O card and the corresponding periphery can be electrically connected through such cable assembly. The other method is to use a standard connector integral with such I/O card.

For a certain consideration, such patent teaches using retractable connection section means within the I/O card for being able to be exposed to an exterior so that the complementary connector, i.e., the modular jack, of a modem can be angularly mated with such exposed mating connection section of the I/O card.

Briefly, the aforementioned three different ways to connect the modem to the I/O card have their own advantages and disadvantages, respectively. For example, the first way, i.e., using an additional cable assembly as an adaptor, necessitates carrying an extra cable whenever use of the modem is desired. Additionally, although the second way, i.e. using an integral standard connector with the I/O card which extends to an exterior, can eliminates the need for carrying extraneous components and eliminates the incompatibility between the I/O card and the modem, such integrated rigid structure of such projecting connector portion of such I/O card may jeopardize the convenience of carrying such I/O card and increase the possibility of breakage of such exposed connection section. Moveover, the third way, i.e., using retractable connection means, may complicates the internal structure of the I/O card so that the cost may substantially increase.

Anyhow, in the recent trend, more than two I/O cards are designedly arranged in a stacked form for use with the computer wherein the distance between such two stacked I/O cards is really tiny due to the size of computer set being smaller. It is obvious that the second and the third ways can not satisfy such critical situation.

Therefore, an object of the present invention is to provide an I/O card which can not only mate with the corresponding periphery directly without any extraneous cable assembly, but also allow plural densely stacked I/O cards to connect to plural corresponding peripheries, respectively.

SUMMARY OF THE INVENTION

According to an aspect of the invention, an I/O card includes a frame shielded by outer covers, and an internal PC board positioned therein. A connector is positioned at one end of the I/O card for mating a corresponding memory card connector in the computer. A deflectable I/O port assembly which can be angularly deformed with regard to the I/O card, extends outwardly at the other end and comprises at least one standard I/O connector whose dimension is substantially larger than the thickness of the I/O card. A flexible section is connected between the standard I/O connector and the I/O card wherein conductors are positioned along the flexible section for electrically connecting the standard I/O connector and the PC board.

BRIEF DESCRIPTION OF THE DRAWINGS

FIG. 2 is an exploded perspective view of the I/O card assembly of FIG. 1 without the top and the bottom covers.

FIG. 3 is a cut-away perspective view of the I/O port assembly of FIG. to shadow the inner I/O connector and the cable therein.

FIG. 4 is a perspective view of a portion of the I/O port assembly to show the connection between the wire of the cable and the contact of the I/O connector.

DETAILED DESCRIPTION OF THE PREFERRED EMBODIMENT

References will now be made in detail to the preferred embodiments of the invention. While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
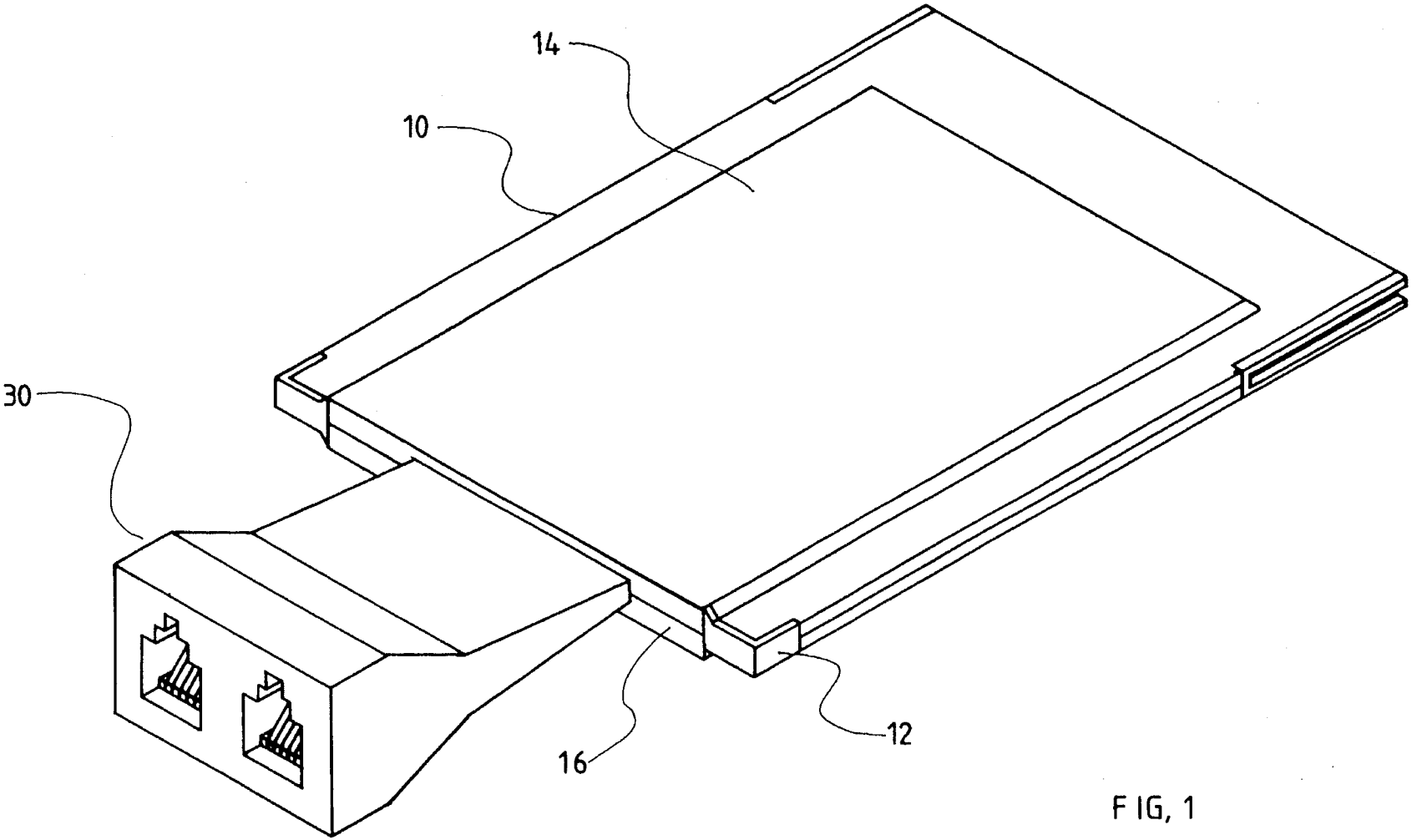
FIG. 1 is a perspective view of an assembled I/O card assembly of the first embodiment according to the present invention.

It will be noted here that for a better understanding, like components are designated by like reference numerals throughout the various figures in the embodiment. Attention is now directed to FIGS. 1 and 2 wherein an I/O card 10 includes a rectangular frame 12 sandwiched between a top cover 14 and a bottom cover 16. (The general structure of the I/O card can be referred to copending application of Ser. No. 08/142,769 which has the same inventor and the same assignee with the invention). The covers 14, 16 have hooks (not shown) along the edges to be captured within the slots 18 on the outer surfaces of the frame 12 for fastening to the frame 12.

An PC board 20 is attachably positioned on the frame 12 by means of a pair of posts 22 of the frame 12 extending into the corresponding apertures 24. (The IC components and the corresponding circuit traces on the PC board 20 are not shown in FIG. 2). A first group of pads 21 are positioned at one (first) end of the board 20 for thereon surface mount of a corresponding socket connector 27 positioned at the same (first) end of the I/O card 10 through a pair of mounting ears 26 being engaged within the corresponding grooves 28 in the frame 12.

The second group of pads 23 are positioned at the other (second) end of the board 20 for thereon electrically connecting to a deflectable I/O port assembly 30 which extends outwardly at the second end of the I/O card 10. Also referring to FIGS. 3 and 4, the I/O port assembly 30 includes two standard modular jack 32 at its front end for coupling to a phone plug (not shown) of a modem. A plurality of cables 34 are positioned between the ends of contacts 36 of the modular jacks 32 and the second ground of pads 23 on the board 20. The exposed copper wires of each cable 34, as shown in FIGS. 2–4, can be connected to the corresponding contact 36 of the modular jack 34 and the pads 23 on the board 20, respectively, in a solder joint form.

A flexible shielding 38 includes a first section 40, at the outer end, which has a large dimension for compliance with the size of the modular jack 32 for enclosing and protecting such pair of modular jacks 32 therein, a third section 44, at the inner end, which has a small dimension for compliance with the size of the interior of the I/O card 10 for fastening within the I/O card 10, and a second section 42 intermediating therebetween which has a tapered configuration for being a transition portion to comply with the dimension change between two opposite ends of the I/O port assembly 30 and for providing flexibility thereof.

The third section 44 has a neck portion 46 whose width conforms to those of the first and the second sections 40, 42 and whose dimension also complies with the opening 25 at the front end of the I/O card 10 so that such neck portion 46 can be received within the opening 25 and allow the second section 42 to protrude outwardly therefrom. The third section 44 also includes in the rear an expansion portion 48 which conforms to the space within the I/O card 10 so that the third section 44 can be compactly received in the I/O card 10. A pair of securing holes 49 are positioned in the expansion portion 48 for engagement with the corresponding protrusions 29 extending upwardly from the frame for securing such expansion portion 48 in the I/O card 10.

Figure 5:
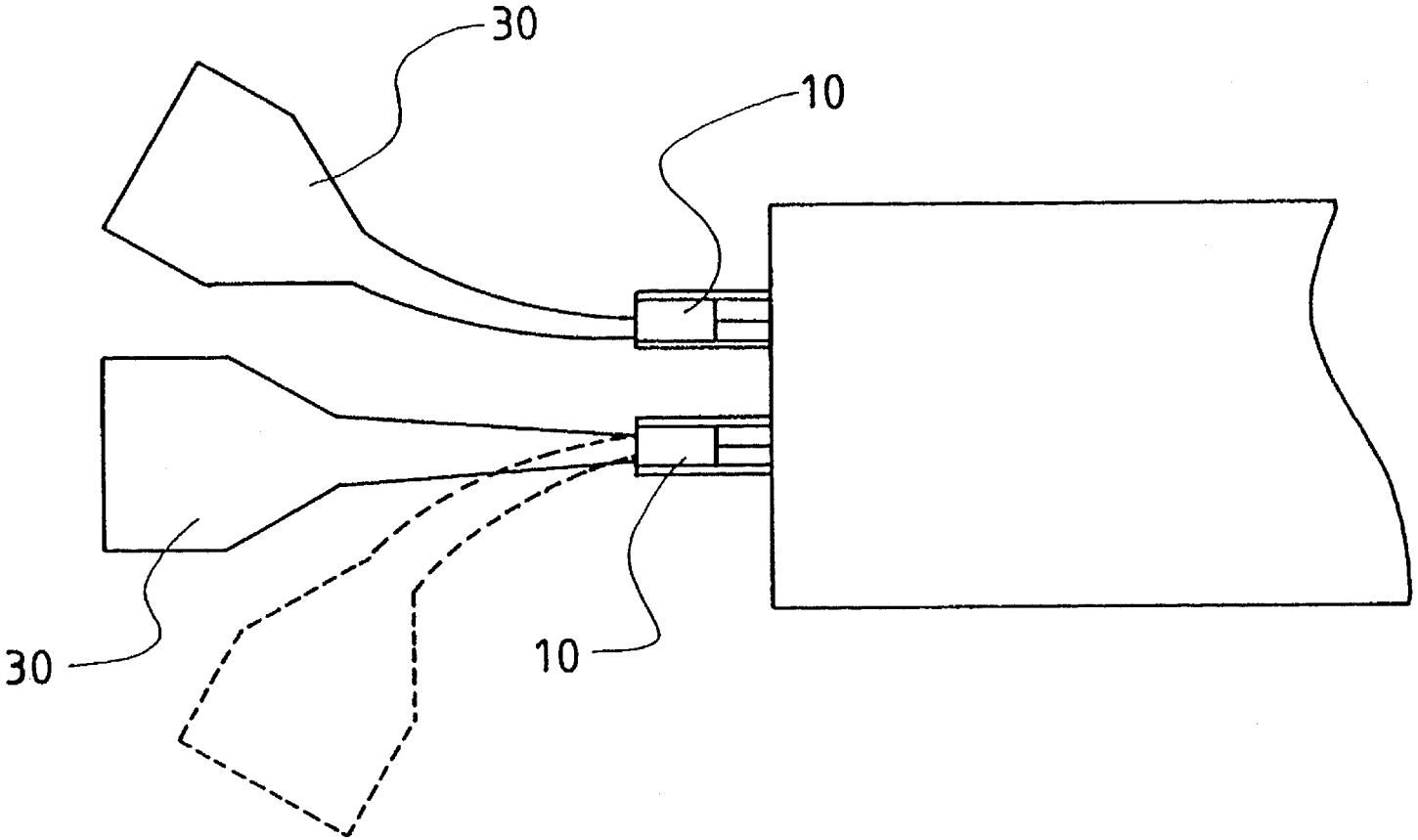
FIG. 5 is a side view of two I/O card assembly stacked together to show the flexibility of the I/O port assembly.

As shown in FIG. 5, two compactly stacked I/O cards can be easily connected to external peripheries through flexibility of their I/O port assemblies.

Figure 6:
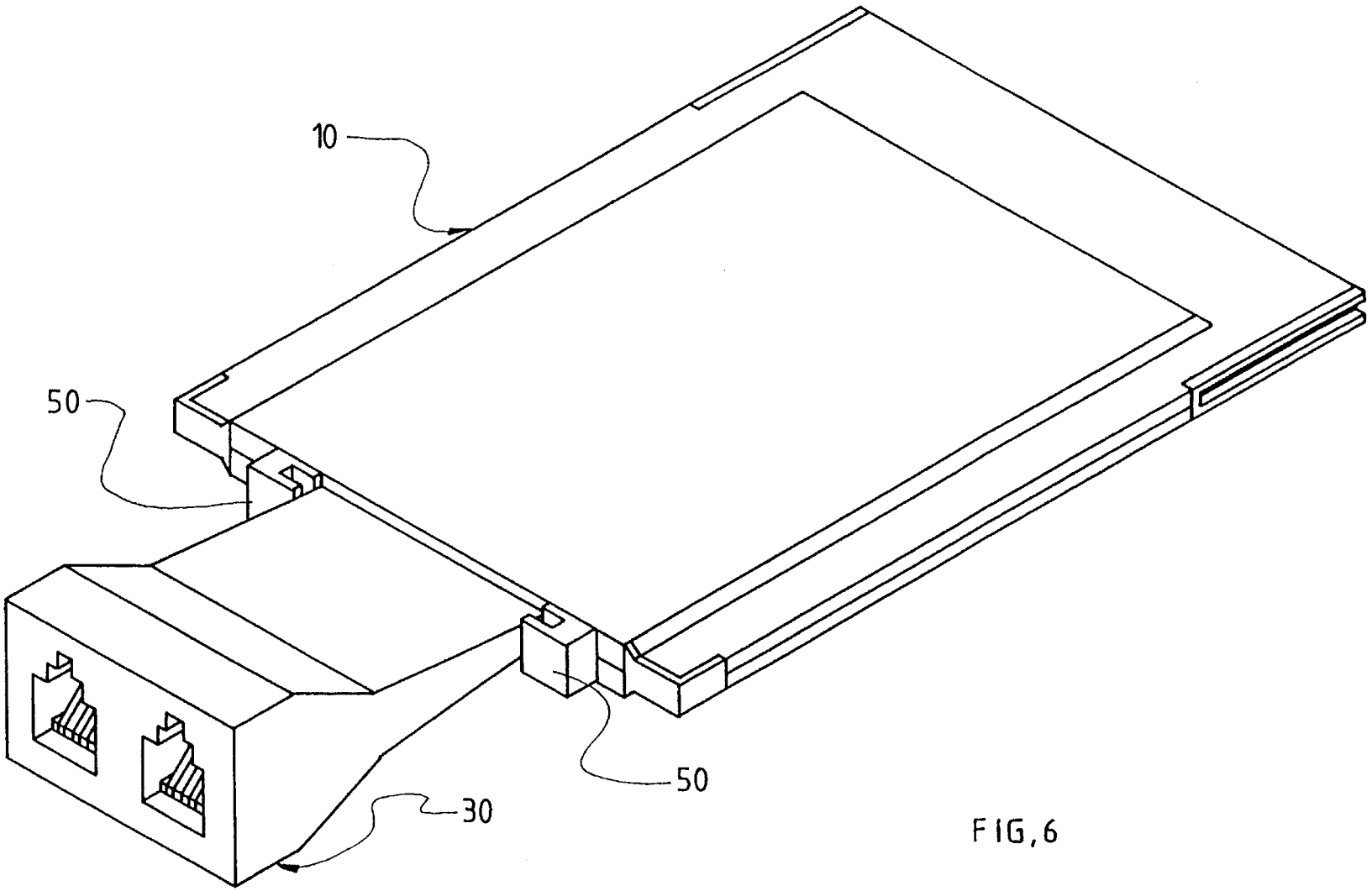
FIG. 6 is a perspective view of an assembled I/O card assembly of the second embodiment according to the present invention.
Figure 7:
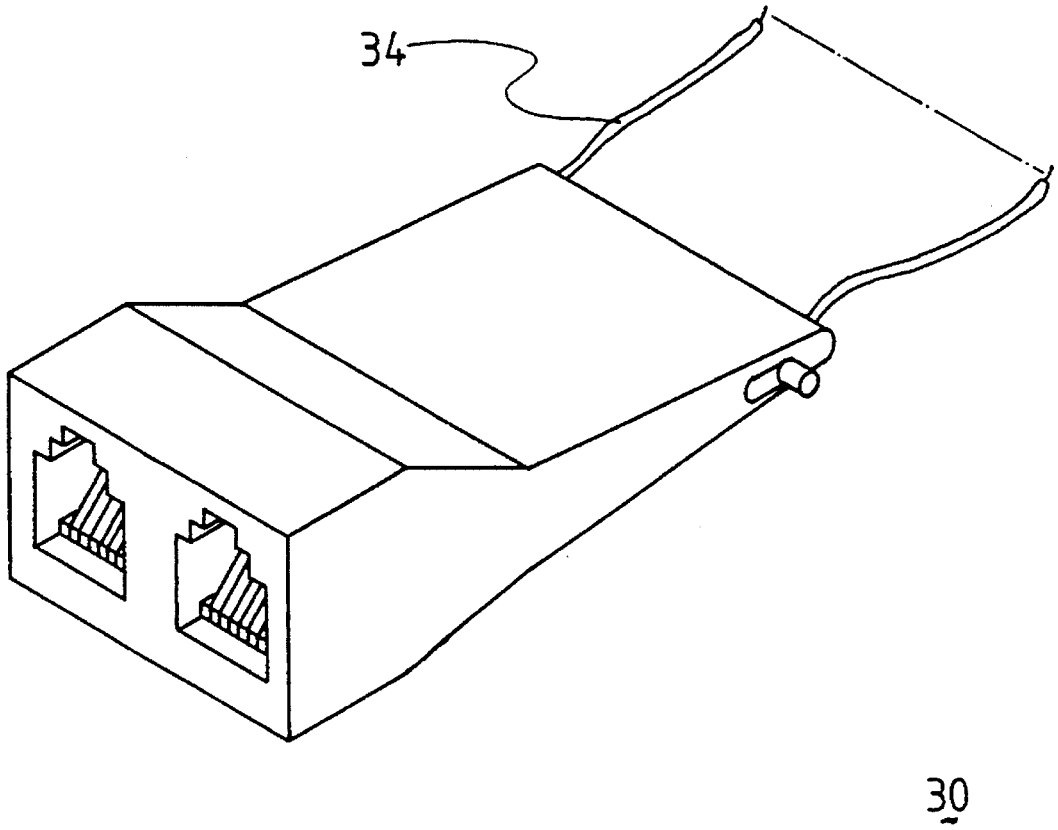
FIG. 7 is a perspective view of the I/O port assembly of FIG. 6.
Figure 8:
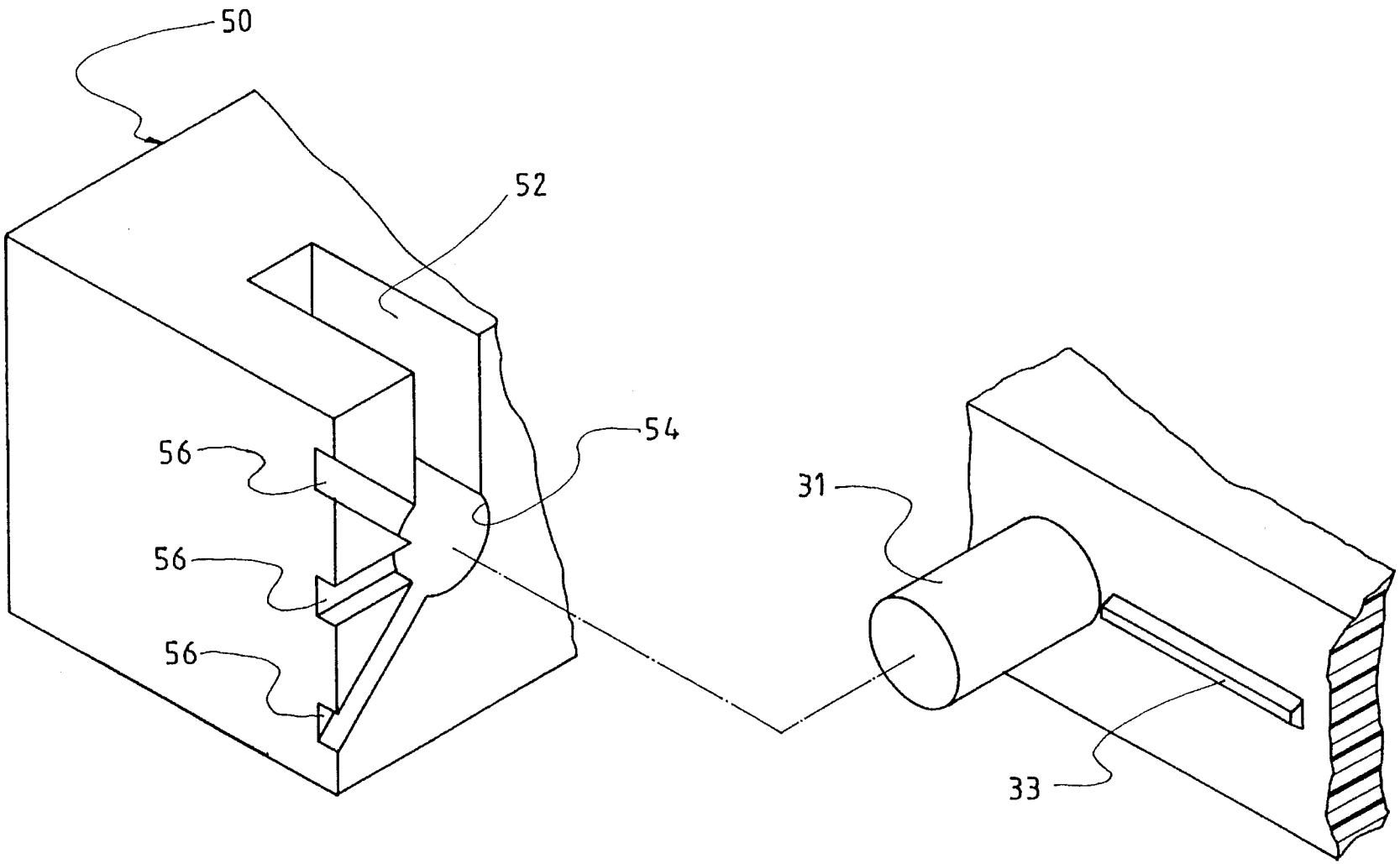
FIG. 8 is a perspective view of a portion of the I/O card assembly to show the pivotal mechanism thereof.

FIGS. 6 and 7 show another embodiment of the invention wherein pivotal or deflectable mechanism replaces flexibility of the material. Each I/O card 10 has a pair of blocks 50 at its front end for sandwiching the rear end of a body of the I/O port assembly therebetween wherein a plurality of cables 34 extend rearward out of such body for entering the interior of the I/O card 10. Also referring to FIG. 8, each block 50 has a slot 52 for allowing the pivotal pin 31 to be installed from the top into the cylindrical groove 54 at the bottom end of the slot 52. The width of the slot 52 is somewhat smaller than the diameter of the groove 54 for assuring such pivotal pin in position. Understandably, such installation of the pivotal pin 31 into the block 50 should be in a form of press fit. Three slots 56 radially extend outwardly at different angles from the center of the groove 54 on the surface of the block 50, and the I/O port assembly 30 includes a retention bar 33 extending along the side surface and proximate the pivotal pin 31, so that through the cooperation of the slots 56 in the block 50 and the retention bar 33 of the I/O port assembly 30, the I/O port assembly 30 can be retainably positioned at a horizontal, an upward slanted and a downward slanted positions. It is noted that this performance is based on the substantial interference relationship between the blocks 50 and the rear end of the body of the I/O port assembly 30. It is also seen that in comparison with the first embodiment which uses inherent flexibility of material, the second embodiment can use a relatively rigid material of the body of the I/O port assembly, and of course eliminate the third section 44 of the first embodiment.

It can be appreciated that the above two embodiments do not disclose all the feasible ways to implement the invention. For example, the I/O connector of the I/O port assembly 30 can be other type I/O connectors, such as D-Sub, SCSI or centronics. Additionally, the connection between the wire of cable 34 and the contact 36 of the modular jack 32 or between the wire of cable 34 and the pads 23 of the PC board 20 can be accomplished by means such as IDC (Insulation Displacement Contact) and header. Moreover, in the first embodiment, the displacement or deformation of the flexible I/O port assembly 30 is mainly derived from the second section 42 thereof, so if allowed, it is only required to have the second section 42 made of flexible material and the first and the third sections 40, 44 still adopt the general rigid material.

While the present invention has been described with reference to a specific embodiment, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. An I/O card assembly for use as an interface between a computer and a periphery, comprising:

an internal PC board supported by a frame and protectively enclosed by covers;

the improvement comprising:

an independent I/O port assembly, which is much thicker than said frame, including at least an I/O connector and attached to a front end of the frame and electrically connected to said internal PC board wherein said I/O port assembly can be angularly displaced with regard to said frame in a vertical direction for not interfering with another I/O port assembly when two I/O card assemblies are arranged in a closely stacked manner in a computer.

2. The I/O card assembly as described in claim 1, wherein said I/O port assembly includes a first section enclosing said at least one I/O connector for mating with a complementary connector of said periphery, a second section for providing flexibility thereof, and a third section compactly received within a space formed by said frame and the covers for fastening said I/O port assembly to the frame.

3. The I/O card assembly as described in claim 1, wherein pivotal mechanism is provided at said front end of the frame and at a rear end of said I/O port assembly for allowing said I/O port assembly to be pivotal with regard to the frame.

4. An I/O card assembly for use as an interface between a computer and a periphery, comprising:

an internal PC board supported by a frame and protectively enclosed by cover means;

an independent I/O port assembly attached to a front end of the frame and electrically connected to said internal PC board wherein said I/O port assembly including therein at least an I/O connector has a thickness substantially much larger than that of said frame with the associated cover means, and said I/O port assembly can be angularly displaced with regard to said frame in a vertical direction so that two said I/O card assemblies can be simultaneously used with external peripheries.

5. The I/O card assembly as described in claim 4, wherein said I/O port assembly has flexibility for purpose of angular displacement with regard to the frame.

6. The I/O card assembly as described in claim 4, wherein said I/O port assembly is provided with pivotal mechanism for purpose of angular displacement with regard to the frame.

7. An arrangement of a pair of stacked type I/O cards in close proximity, each of said I/O cards including:

an internal PC board supported by a frame and protectively enclosed by cover means;

an independent I/O port assembly, which is much thicker than said frame, including at least an I/O connector, said I/O port assembly being attached to a front end of the frame and electrically connected to said internal PC board whereby when said pair of I/O cards are simultaneously used with a computer, at least the I/O port assembly of one of said pair of I/O cards can be angularly displaced for not interfering with the I/O port assembly of another I/O card in a vertical direction.

* * * * *